US006129238A

United States Patent [19]

Rumminger

[11] Patent Number: 6,129,238

[45] Date of Patent: Oct. 10, 2000

[54] VENDING MACHINE

[75] Inventor: Ken S. Rumminger, 2426 Hwy. 86, Apt. 2, Piedmont, S.C. 29673

[73] Assignee: Ken S. Rumminger, Piedmont, S.C.

[21] Appl. No.: 09/162,266

[22] Filed: Sep. 29, 1998

Related U.S. Application Data

[60] Provisional application No. 60/060,449, Sep. 30, 1997.

[51] Int. Cl.[7] ..... G07F 11/00

[52] U.S. Cl. ..... 221/24; 221/155; 221/265; 221/97

[58] Field of Search ..... 221/24, 155, 265, 221/97

[56] References Cited

U.S. PATENT DOCUMENTS

| | | | |
|---|---|---|---|
| 4,976,376 | 12/1990 | Williams | 221/24 |
| 5,452,822 | 9/1995 | Haymond | 221/155 |
| 5,513,772 | 5/1996 | Glaser | 221/211 |
| 5,782,378 | 7/1998 | Hart et al. | 221/24 |
| 5,788,115 | 8/1998 | Halliburton | 221/155 |
| 5,897,022 | 4/1999 | Mann | 221/24 |
| 5,931,338 | 8/1999 | Hoeting et al. | 221/24 |
| 6,056,151 | 5/2000 | Peery et al. | 221/24 |

*Primary Examiner*—Christopher P. Ellis
*Assistant Examiner*—Rashmi Sharma
*Attorney, Agent, or Firm*—Dority & Manning, P.A.

[57] ABSTRACT

A coin-operated vending machine includes a cabinet defining a game area and a reservoir for receiving pieces of product. A transparent front panel may be vertically slidably received in the cabinet to form a front boundary of the game area. A propelling mechanism is configured to propel a product piece through the game area to an output mechanism. The output mechanism may include a slot having a V-shaped cross-section and a hole defined by a front surface of the cabinet opening to the slot. A rod may be vertically received through a coin mechanism to retain the coin mechanism in the cabinet.

35 Claims, 7 Drawing Sheets

VENDING MACHINE

This present application claims priority to U.S. Provisional Patent Application Ser. No. 60/060,449, filed Sep. 30, 1997.

BACKGROUND OF THE INVENTION

The present invention relates to vending machines and, more particularly, to vending machines dispensing product for use in a game area within the vending machine.

Some vending machines, particularly gumball and other coin-operated candy machines, release product into a game area within the machine. The game area may include a flipper to propel a gumball through a game sequence before the gumball is deposited in an output slot. Typically, a hopper mechanism, which releases the gumball from a gumball reservoir, is disposed above the flipper mechanism so that gravity directs the gumball from the hopper to the flipper.

In such game-type gumball machines, a transparent front panel may be provided so that the customer is able to view a game area within the machine. The area may include various game components such as illustrations, tracks, bumpers, lights and/or targets for gumballs released from the flipper. These components may require periodic cleaning or replacement, and the game area in general may otherwise require maintenance and cleaning. Since the machines are sometimes placed against or attached to walls, however, rear access may be inconvenient. The transparent front panel may therefore be disposed on a frame hinged to the machine cabinet so that the front panel opens in a door-like fashion to provide front access to the game area. Such doors require latches and seals and may require the operator to maintain an extra key.

A coin mechanism is generally provided in a gumball vending machine to receive coins from customers and to actuate the hopper. In machines having a hinged front panel as described above, the coin mechanism is typically below the front panel. Since gumballs are dropped into the game area from a reservoir either above or behind the game area, the hopper is generally disposed above or within the area. Thus, the hopper and coin mechanism are generally disposed apart from each other, and an electric switch at the coin mechanism may be provided to control a motor to actuate the hopper.

SUMMARY OF THE INVENTION

The present invention recognizes and addresses disadvantages of prior constructions and methods.

Accordingly, it is an object of the present invention to provide an improved coin-operated vending machine.

It is a further object of the present invention to provide a coin-operated vending machine constructed for ease of assembly and disassembly.

Some of these objects are achieved in one embodiment of the present invention by a coin-operated vending machine including a cabinet defining a game area and a reservoir for receiving vending product. An output mechanism is in communication with the game area and is configured to output the product pieces from the area to the user. A propelling mechanism is in communication with the game area and is configured to propel a product piece through the game area to the output mechanism. A hopper is disposed in the cabinet in communication with the reservoir. The hopper is configured to receive a product piece from the reservoir and to output it to the propelling mechanism. A coin mechanism is in operative communication with the hopper and is configured to receive at least one coin from the user and to control the hopper to output the product piece to the propelling mechanism from the reservoir responsively thereto. The cabinet includes a transparent front panel vertically slidably received therein and forming a front boundary of the game area.

In another embodiment of the present invention, a coin-operated vending machine includes a cabinet defining a game area and defining a reservoir for receiving pieces of product. An output mechanism is in communication with the game area and is configured to output the pieces from the area to a user. A propelling mechanism is in communication with the game area and is configured to propel a product piece through the game area to the output mechanism. A hopper is disposed in the cabinet in communication with the reservoir. The hopper is configured to receive the product piece from the reservoir and to output it to the propelling mechanism. A coin mechanism is in operative communication with the hopper and is configured to receive at least one coin from the user and to control the hopper to output a product piece to the propelling mechanism from the reservoir responsively thereto. The output mechanism includes at least one slot having a V-shaped cross section, with respect to a front surface of the cabinet, and a hole defined by the front surface opening to the slot.

In a further preferred embodiment of a coin-operated vending machine according to the present invention, a cabinet defines a reservoir for receiving pieces of product. An output mechanism is configured to output the pieces from the cabinet to the user. A hopper is disposed in the cabinet in communication with the reservoir. The hopper is configured to receive a product piece from the reservoir and to output it to the output mechanism. A coin mechanism is slidably received into the cabinet in a first direction and in operative communication with the hopper. The coin mechanism is configured to receive at least one coin from the user and to control the hopper to output the product piece to the output mechanism from the reservoir responsively thereto. A rod is secured to the cabinet in the first direction and is slidably received through a hole through the coin mechanism in a second direction perpendicular to the first direction to retain the coin mechanism in the cabinet. A stop is operatively shaped so that it is unable to pass through the hole. The stop is removably disposed on the rod so that, when disposed on the rod, the stop prevents removal of the rod from the hole and that, when removed from the rod, the rod is slidably removable from the hole.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
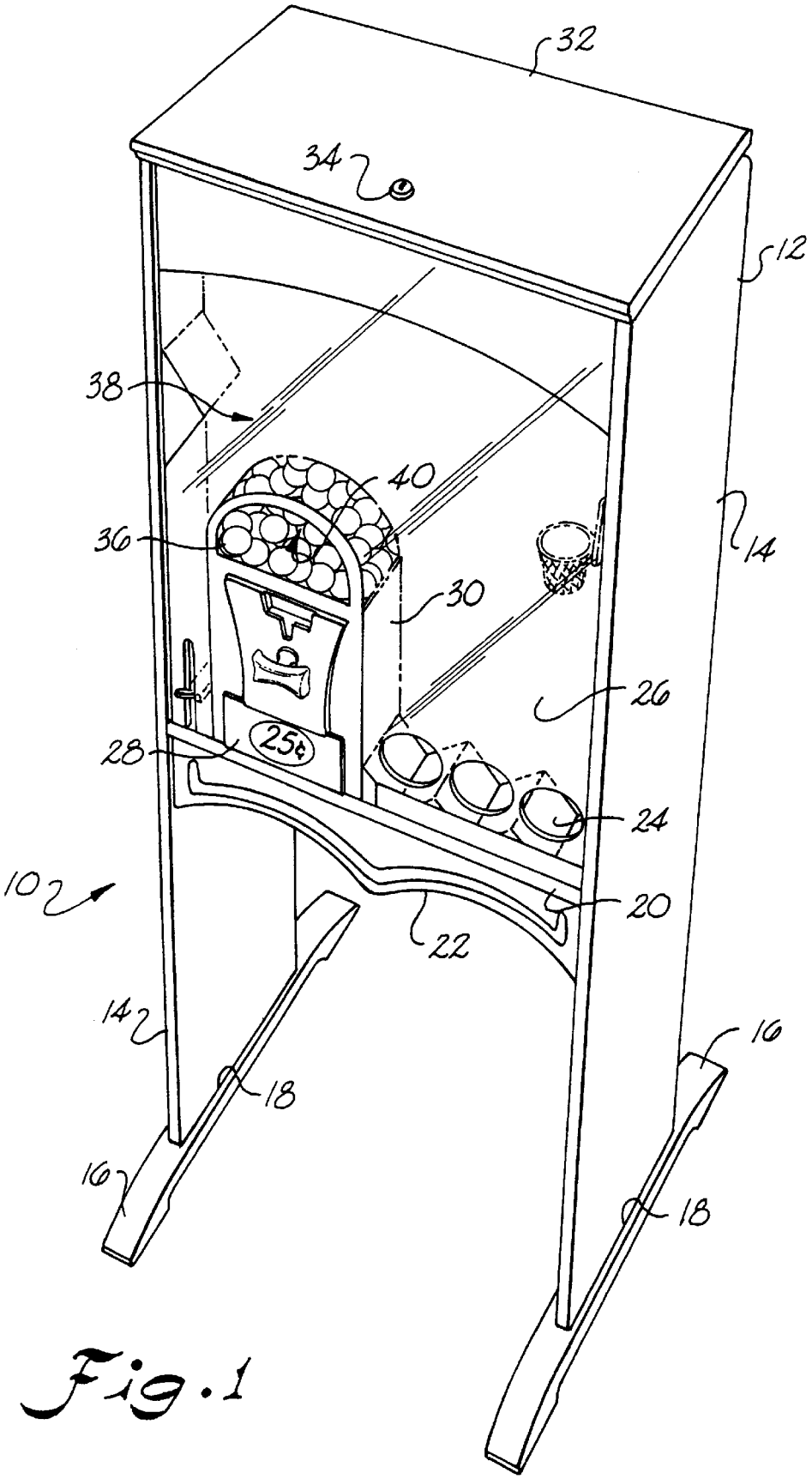
FIG. 1 is a perspective view of an embodiment of a coin-operated vending machine according to the present invention.

Repeat use of reference characters in the present specification is intended to represent same of analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of appended claims and their equivalents.

One presently preferred embodiment of a vending machine constructed in accordance with the present invention is illustrated at gumball machine 10 in FIG. 1. Gumball machine 10 includes a cabinet 12 having sides 14 supported by feet 16. Each foot 16 is constructed as a removable arch having a slot 18 for receiving a respective side 14. A bottom 20 is disposed above a decorative piece 22 and below a gumball catcher 24, a transparent front panel 26, a coin box 28 and a housing 30 enclosing the hopper, coin mechanism and coin box.

A top 32 is hinged at its rear to the rear of cabinet 12. A lock 34 is provided to secure the machine 10. Gumballs 36 may be loaded into a gumball reservoir (not shown) in the rear portion of the machine through the opened top. Although the gumball reservoir is behind a game area 38 in the front half of machine 10, a secondary gumball reservoir 40 extends into game area 38 so that gumballs are visible to customers.

Feet 16, sides 14, decorative piece 22, bottom 20, housing 30, top 32, coin box 28, catcher 24 and various other parts of machine 10 may be constructed of wood, metal, plastic or other suitable material. Front 26 may be constructed of any suitable transparent material, for example plexiglass.

Figure 2:
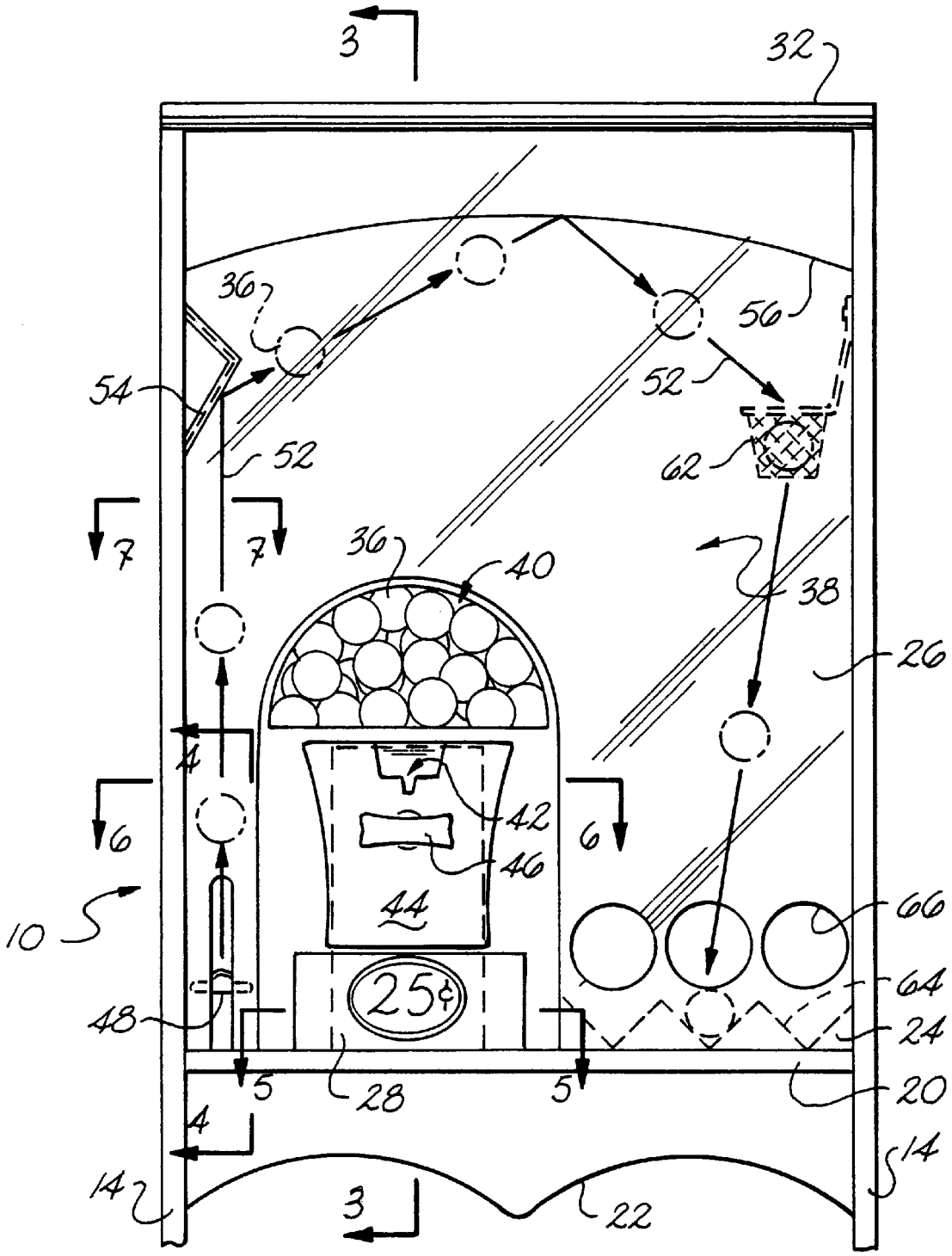
FIG. 2 is a partial front plan view of the vending machine as in FIG. 1.

FIG. 2 illustrates the operation of game area 38. When a coin is inserted into a slot 42 of a coin mechanism 44, rotation of handle 46 releases a gumball 36 from the gumball reservoir to a flipper 48. As also illustrated in FIG. 4, depression of flipper 48, which may be constructed of any suitable resilient material such as a semi-rigid plastic, in the direction of arrow 50 and subsequent release propels gumball 36 upward in the direction of arrows 52. The gumballs are deflected from a first carom surface 54 to a second carom surface 56. In the embodiment illustrated in FIG. 2, first carom surface 54 is formed by a V-shaped member attached to a side 14. Also referring to FIG. 3, second carom surface 56 is formed by an arched block 58 supporting a flexible plastic crosspiece 60. From second carom surface 56, the gumball is directed toward a miniature basketball goal 62 and downward to catcher 24. As is described in more detail below, basketball goal 62 may be provided with an electric switch to activate the hopper so that if a gumball is successfully propelled through the basketball goal, the hopper releases an extra gumball to flipper 48.

Catcher 24 includes three V-shaped receiving slots 64 to receive gumballs 36. The gumballs are retrieved from the slots through holes 66 in front panel 26. Thus, catcher 24 and holes 66 form a gumball output mechanism. Slots 64 reduce the tendency of the gumballs to bounce in the output mechanism. Thus, guard mechanisms, for example hinged flaps, over holes 66 may be omitted.

Figure 3:
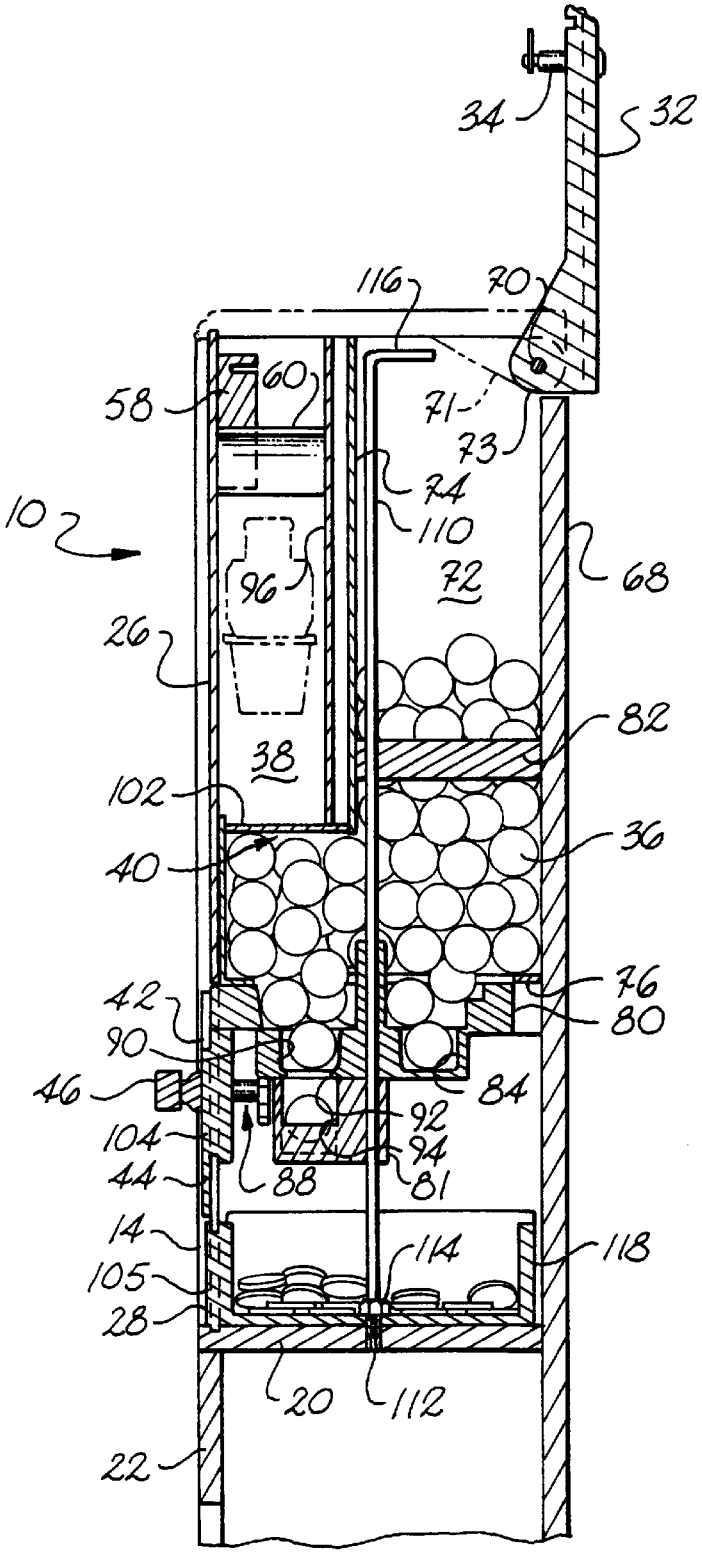
FIG. 3 is a cross-sectional view of the vending machine shown in FIG. 1 taken along the line 3—3 in FIG. 2.
Figure 4:
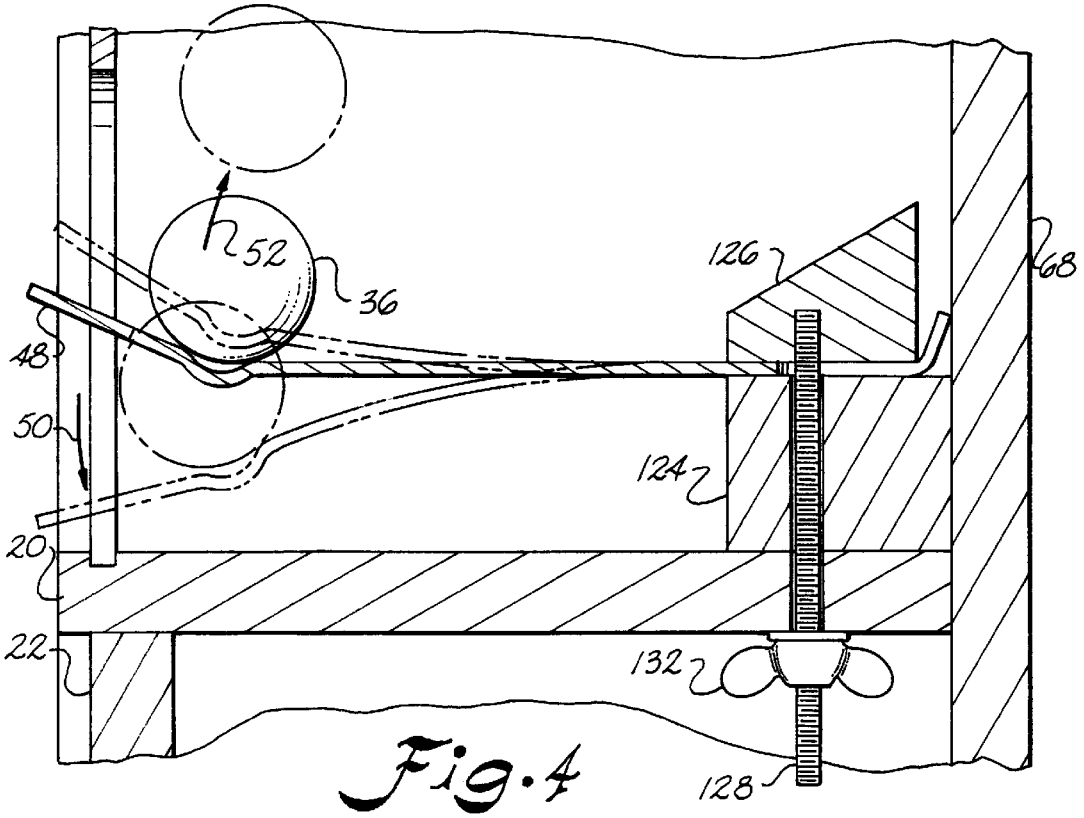
FIG. 4 is a cross-sectional view of the vending machine as in FIG. 1 taken along the line 4—4 in FIG. 2.

The cross-sectional view of machine 10 in FIG. 3 illustrates the machine's product storage area and dispensing mechanism. Top 32 is pivotally attached to sides 14 (FIG. 1) at 70. Top 32 includes a back rim member 71 (see also FIG. 8) having a beveled rear edge 69 (FIG. 8) to allow top 32 to pivot at 70 to open and close over back panel 68. Although, for purposes of clarity, a gap is shown between the top of back panel 68 and the back rim member 71, the beveled rear edge may extend so that its inward edge 73 contacts the opposing inward edge of back panel 68 when top 32 is closed. The sealing effect may be enhanced by including a rubber, foam or plastic strip along inward edge 73 or the opposing inward edge of back panel 68.

Figure 8:
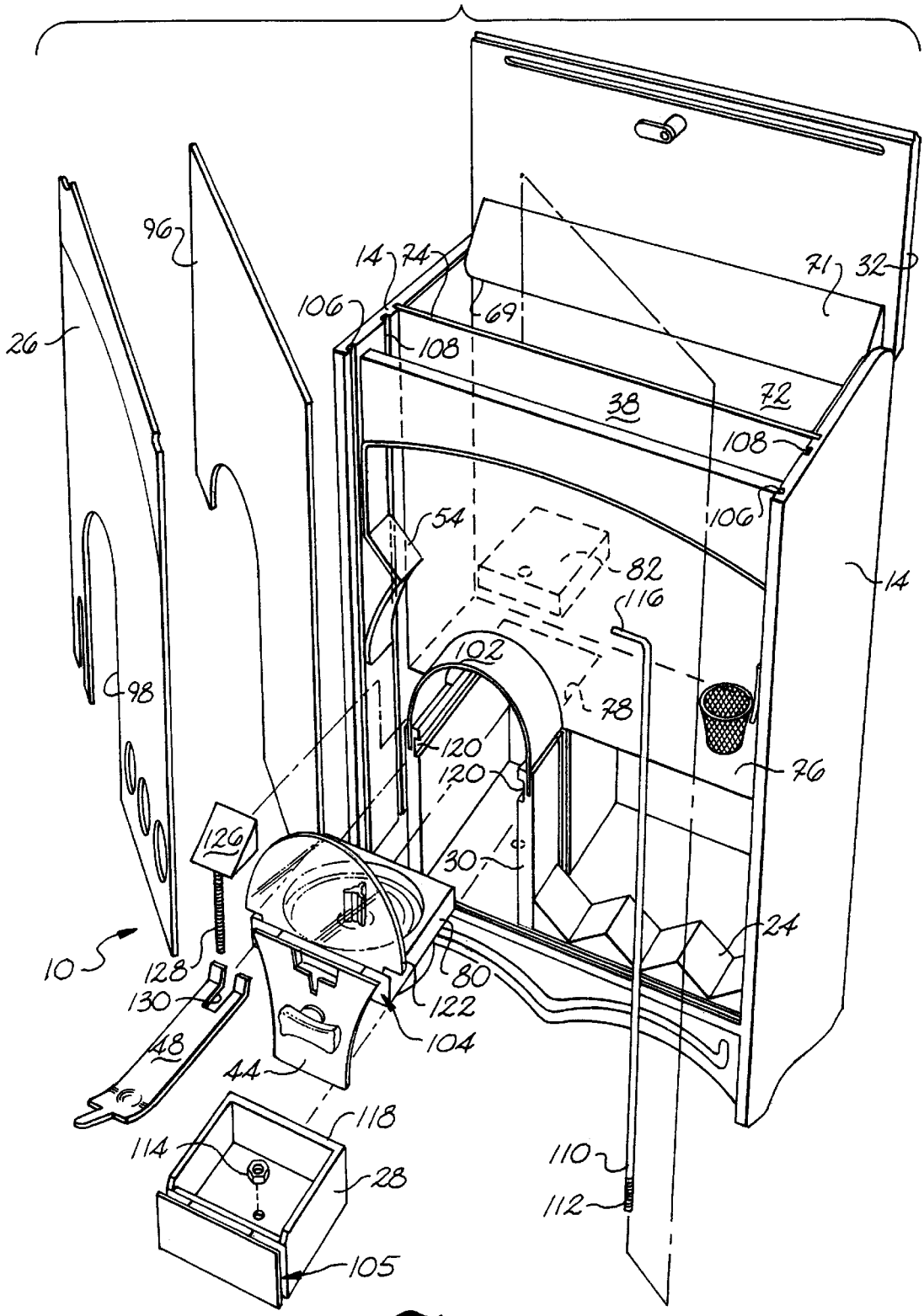
FIG. 8 is a partial exploded view of the vending machine as in FIG. 1.

When back panel 68 is in the open position illustrated in FIG. 3, gumballs 36 may be loaded into a rear gumball reservoir 72 defined between back panel 68, sides 14 (FIG. 1) and rear center panel 74. As is also shown in FIG. 8, a floor 76 forms the bottom of reservoir 72 and includes a cut-out portion 78 above hopper 80. A shelf 82 extends between back panel 68 and rear center wall 74 above cut-out portion 78 to prevent excessive downward force on the hopper.

Figure 6:
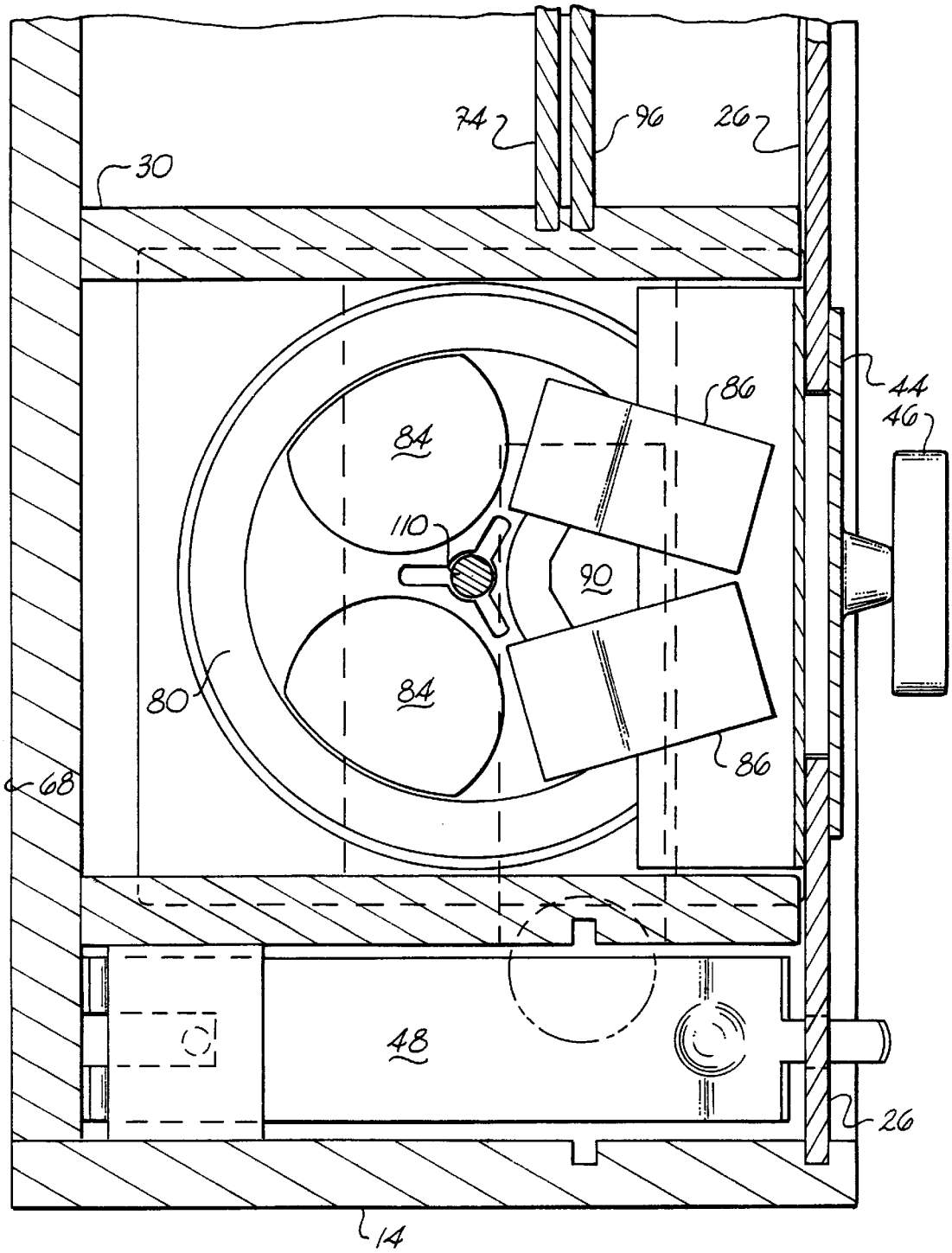
FIG. 6 is a cross-sectional view of the vending machine as in FIG. 1 taken along the line 6—6 as in FIG. 2.

Referring to FIGS. 3 and 6, gumballs 36 are directed by ramps 86 to rear holes 84 in the hopper's carousel. When a coin is inserted into slot 42 and handle 46 is rotated, gear mechanism 88 of coin mechanism 44 rotates the carousel so that one of the rear holes 84 is rotated to become front hole 90, thereby dropping a gumball through hole 92 into slot 94 in a lateral member 81 extending between the sides of housing 30. Slot 94 extends to flipper 48 so that the gumball is deposited on the flipper.

Figure 5:
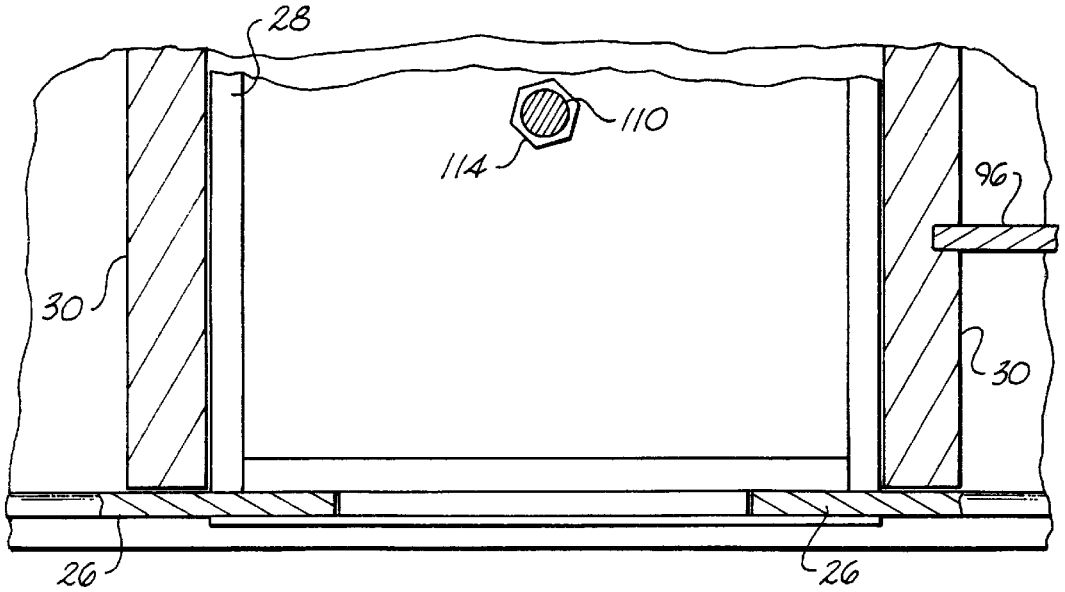
FIG. 5 is a cross-sectional view of the vending machine as in FIG. 1 taken along the line 5—5 as in FIG. 2.

Accordingly, gumballs may be transferred from reservoir 72 to flipper 48 through a relatively simple and inexpensive mechanical linkage between coin mechanism 44 and hopper 80. To simplify the linkage, coin mechanism 44 is disposed within game area 38 in conjunction with hopper 80. Accordingly, transparent front panel 26 includes slot 98 to receive coin mechanism 44 and coin box 28. Front center panel 96 includes slot 100 to receive housing 30 and domed cover 102 of reservoir 40. Accordingly, hopper 80, coin mechanism 44 and reservoir 40 extend into game area 38 so that game area 38 is bordered by sides 14, bottom 20, housing 30, crosspiece 60, and cover 102. The sides of slot 98 are received by slot 104 of coin mechanism 44 and, as also shown in FIG. 5, slot 105 in coin box 28.

Components of machine 10 are easily installed and removed from the front and top of the cabinet, as illustrated in FIG. 8. Transparent front panel 26 and front center panel 96 are slidably received into respective opposing slots 106 and 108 in sides 14. Thus, the panels may be removed for cleaning and maintenance and to allow access to the machine interior. In the embodiment illustrated, reservoir floor 76 and rear center panel 74 are fixed within the cabinet, but may be removably attached as well.

Figure 7:
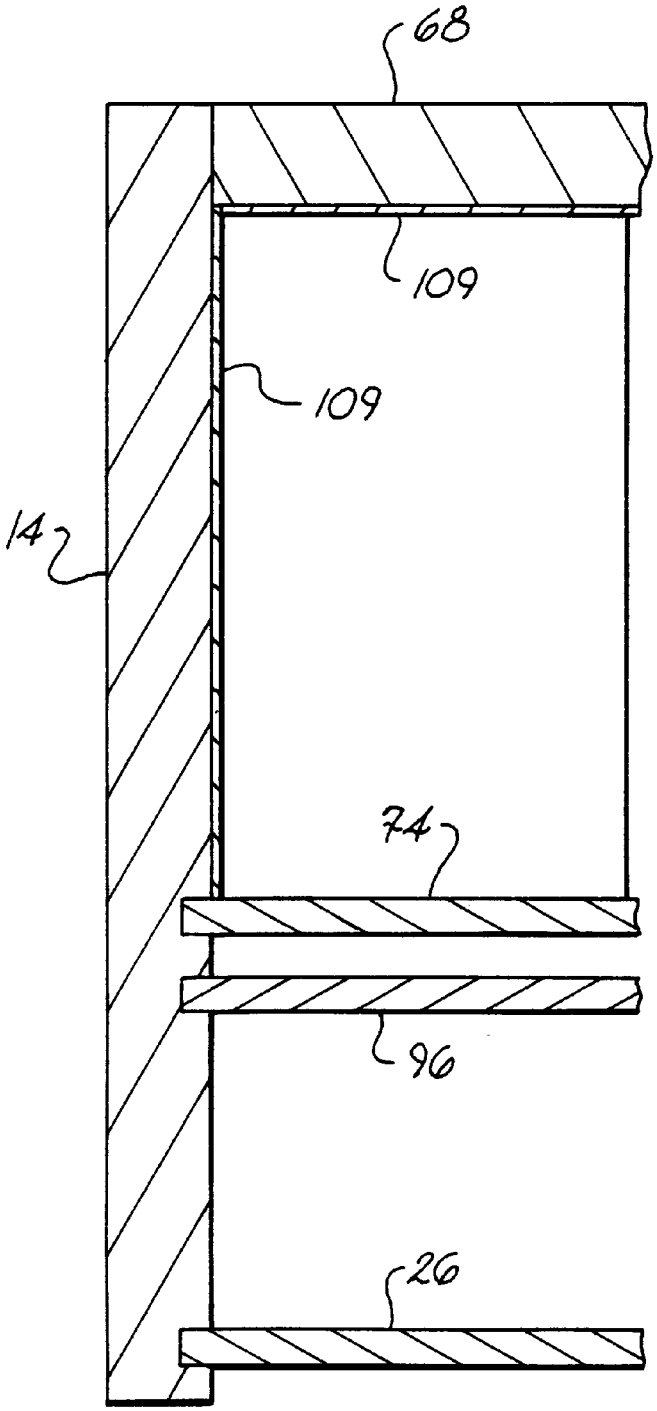
FIG. 7 is a cross-sectional view of the vending machine as in FIG. 1 taken along the line 7—7 as in FIG. 2.

Referring also to FIG. 7, a liner 109, for example made of coated or finished wood or plastic, may be provided along the portions of sides 14 and back panel 68 within reservoir 72 to facilitate cleaning. It should be understood, however, that such coating or finishing may be applied directly to the surfaces of sides 14 and back panel 68. Such surfaces may also be applied to rear center panel 74 and floor 76, which are not typically visible to a customer.

Front center panel 96 may be provided with a game display, for example illustrating a basketball player jumping toward basketball goal 62, "points scored" illustrations at each of the slots 64 in catcher 24, and other various designs. Furthermore, lamps or LEDs may be provided within the display. For example, a series of lights may be disposed on the panel in a line from first carom surface 54 to second carom surface 56 to basketball goal 62, wherein the lights consecutively flash to illustrate a gumball's path to the goal. Moreover, a variety of game components may be disposed on the front center panel 96 and/or front panel 26. Thus, the game area may be easily serviced by removing the panels. Furthermore, the game itself may be changed by exchanging the panels with panels having different game components to execute a new game.

Referring also to FIG. 3, a rod 110 extends through reservoir 72, hopper 80 and lateral member 81 into coin box 28. A hole is provided in coin box 28 and bottom 20 to receive the threaded end 112 of rod 110. A nut 114 having a diameter larger than the holes through lateral member 81, coin box 28 and floor 20 is threaded onto end 112. Thus, the nut provides a stop to hold rod 110 vertically in place.

To remove the coin box, top 32 is unlocked and opened. Transparent front panel 26 is then lifted out of slot pair 106, thereby removing the panel from slots 104 and 105 of the coin mechanism and coin box, respectively. The operator may then lift rod 110 by an upper handle portion 116 until threaded end 112 clears the holes in floor 20 and coin box 28. Rod 110 is lifted high enough, for example until nut 114 abuts the bottom of lateral member 81, so that the bottom of threaded end 112 clears the back edge 118 of coin box 28. Coin box 28 may then be pulled forward out of housing 30.

If it is then desired to remove the coin mechanism and hopper, the operator may reach into the space vacated by the coin box, unscrew nut 114, pull the rod through lateral member 81 (for purposes of clarity not illustrated in FIG. 8), hopper 80 and shelf 82 and remove the rod from the machine. The coin mechanism/hopper assembly, which is received and vertically support by slots 120 in housing 30, may then be pulled forward to slidably remove the assembly from the housing. A transparent front panel 122, which forms the front of reservoir 40, is attached to the coin mechanism/hopper assembly and is removed therewith. It should be understood, however, that such a panel may be permanently attached to the housing, for example to cover 102.

Flipper 48 may be removed following removal of transparent front panel 26. Referring to FIGS. 4 and 8, flipper 48 is held in place at its rearward end between a lower block 124 and an upper block 126. A threaded bolt 128 is fixed to and extends from upper block 126 through a slot 130 in flipper 48 and holes through lower block 124 and floor 20. A nut 132 threads onto bolt 128 against floor 20 to clamp upper block 126 downward onto the rear portion of flipper 48, thereby securing the flipper into position. The width of slot 130 is greater than the diameter of bolt 128 so that the position of the flipper is laterally adjustable. Although not illustrated in FIG. 4, a clearance may be provided between the rearmost end of flipper 48 and back panel 68 so that the depth of the flipper may be adjusted as well.

An electric switch may be provided in basketball goal 62 so that the switch is activated when a gumball passes through the goal. An electric motor controlled by the switch may be disposed at the interior side of back panel 68 below hopper 80. The motor controls a gearing mechanism, such as gearing mechanism 88, to drive the hopper carousel. When a gumball activates the basketball goal switch, a signal from the switch activates the motor to rotate the carousel to deposit an extra gumball in slot 94. In this embodiment, the gearing mechanism 88 between coin mechanism 44 and carousel 84 may be omitted, and an electric switch may be provided at the coin mechanism to activate the motor when a coin is deposited in slot 42 and handle 46 is rotated. Alternatively, such a switch may be provided within the machine below the coin mechanism so that the switch is activated as a coin drops from the coin mechanism into the coin box.

While one or more particular embodiments of the invention have been described and shown, it should be understood by those of ordinary skill in this art that the present invention is not limited thereto since many modifications can be made. Therefore, it is contemplated by the present application to cover any and all such embodiments that may fall within the literal or equivalent scope of the appended claims.

What is claimed is:

1. A coin-operated vending machine, said vending machine comprising:

a cabinet defining a game area and defining a reservoir for receiving pieces of product;

an output mechanism in communication with said game area and configured to output said product pieces from said area to a user;

a propelling mechanism in communication with said game area and configured to propel a said product piece through said game area to said output mechanism;

a hopper disposed in said cabinet in communication with said reservoir, said hopper being configured to receive said product piece from said reservoir and to output said product piece to said propelling mechanism; and a coin mechanism in operative communication with said hopper and configured to receive at least one coin from said user and to control said hopper to output said product piece to said propelling mechanism from said reservoir responsively thereto, wherein said cabinet includes a transparent front panel vertically slidably received therein and forming a front boundary of said game area.

2. The vending machine as in claim 1, wherein said reservoir is disposed in said cabinet above said propelling mechanism and wherein said hopper is disposed operatively vertically between said reservoir and said propelling mechanism so that said product piece is gravitationally drawn to said hopper from said reservoir and to said propelling mechanism from said hopper.

3. The vending machine as in claim 2, wherein said coin mechanism extends through said game area, and wherein said front panel defines a recess to slidably receive said coin mechanism.

4. The vending machine as in claim 3, wherein said coin mechanism mechanically drives said hopper.

5. The vending machine as in claim 1, wherein said propelling mechanism includes a flipper.

6. The vending machine as in claim 1, wherein said cabinet defines an opening in a top end of said cabinet and in communication with said game area.

7. The vending machine as in claim 6, wherein said reservoir is adjacent to said game area and is in communication with said cabinet top opening.

8. The vending machine as in claim 6, wherein said cabinet includes a lid selectively covering said top opening.

9. The vending machine as in claim 1, wherein said output mechanism includes at least one slot having a V-shaped cross section with respect to said transparent front panel and a hole defined by said transparent front panel, said hole opening to said slot.

10. The vending machine as in claim 6, including a coin box horizontally slidably received into said cabinet and in communication with said coin mechanism to receive said at least one coin therefrom, and a rod horizontally secured to and extending vertically through said cabinet and received by said coin box to retain said coin box in said cabinet, said rod being vertically slidable within said cabinet to permit removal of said coin box horizontally from said cabinet.

11. The vending machine as in claim 10, wherein said coin box defines a hole receiving an end of said rod and wherein a stop is disposed on said rod proximate said end, said stop being operatively shaped so that it is unable to pass through said hole, thereby preventing insertion of said rod beyond said stop into said hole.

12. The vending machine as in claim 6, including a coin box horizontally slidably received into said cabinet and in communication with said coin mechanism to receive said at least one coin therefrom, a rod horizontally secured to and extending vertically through said cabinet and having an end received by said coin box to retain said coin box in said cabinet, a stop disposed on said rod proximate said end, and a shoulder disposed within said cabinet, wherein said rod is vertically slidable within said cabinet to remove said end from said coin box and wherein said shoulder is disposed with respect to said rod so that said stop abuts said shoulder upon upward vertical movement of said rod a distance at least sufficient to permit removal of said end from said coin box.

13. The vending machine as in claim 12, wherein said coin mechanism is horizontally slidably received into said cabinet, wherein said stop is removably attached to said rod, and wherein said rod is slidably received through a vertical hole in said coin mechanism to retain said coin mechanism in said cabinet and so that, upon removal of said stop from said rod, said rod may be withdrawn from said coin mechanism to permit removal of said coin mechanism from said cabinet.

14. The vending machine as in claim 13, wherein one of said coin mechanism and said hopper defines said shoulder.

15. A coin-operated vending machine, said vending machine comprising:

a cabinet defining a game area and defining a reservoir for receiving pieces of product;

an output mechanism in communication with said game area and configured to output said product pieces from said area to a user;

a propelling mechanism in communication with said game area and configured to propel a said product piece through said game area to said output mechanism;

a hopper disposed in said cabinet in communication with said reservoir, said hopper being configured to receive said product piece from said reservoir and to output said product piece to said propelling mechanism; and a coin mechanism in operative communication with said hopper and configured to receive at least one coin from said user and control said hopper to output a said product piece to said propelling mechanism from said reservoir responsively thereto;

wherein said output mechanism includes at least one slot having a V-shaped cross section, with respect to a front surface of said cabinet, and a hole defined by said front surface opening to said slot.

16. The vending machine as in claim 15, wherein said output mechanism includes a plurality of said slots and respective said holes.

17. A coin-operated vending machine, said vending machine comprising;

a cabinet defining a reservoir for receiving pieces of product;

an output mechanism configured to output said product pieces from said cabinet to a user;

a hopper disposed in said cabinet in communication with said reservoir, said hopper being configured to receive said product piece from said reservoir and to output said product piece to said output mechanism;

a coin mechanism slidably received into said cabinet in a first direction and in operative communication with said hopper, said coin mechanism being configured to receive at least one coin from said user and to control said hopper to output said product piece to said output mechanism from said reservoir responsively thereto;

a rod secured to said cabinet in said first direction and slidably received through a hole through said coin mechanism in a second direction perpendicular to said first direction to retain said coin mechanism in said cabinet; and a stop operatively shaped so that said stop is unable to pass through said hole, said stop being removably disposed on said rod so that, when disposed on said rod, said stop prevents removal of said rod from said hole and that, when removed from said rod, said rod is slidably removable from said hole.

18. The vending machine as in claim 17, wherein said coin mechanism is horizontally received into said cabinet and wherein said hole is vertically defined through said coin mechanism.

19. The vending machine as in claim 18, including a coin box horizontally slidably received into said cabinet below and in communication with said coin mechanism to receive said at least one coin therefrom, said coin box receiving an end of said rod to retain said coin box in said cabinet, and a shoulder disposed within said cabinet, wherein said shoulder is disposed with respect to said rod so that said stop abuts said shoulder upon upward vertical movement of said rod a distance at least sufficient to permit removal of said end from said coin box.

20. The vending machine as in claim 19, wherein one of said coin mechanism and said hopper defines said shoulder.

21. A coin-operated vending machine, said vending machine comprising:

a cabinet defining a game area, a reservoir for receiving pieces of product, and an opening in a top end of said cabinet in communication with said game area and said reservoir;

at least one slot disposed in said game area and having a V-shaped cross section with respect to a front surface of said cabinet, said front surface defining a hole opening to said slot to output said product pieces from said game area to a user;

a flipper disposed in said game area and configured to propel a said product piece through said game area to said at least one slot;

a hopper disposed in said cabinet vertically operatively between said reservoir and said flipper, said hopper being configured to receive said product piece from said reservoir;

a coin mechanism horizontally slidably received into said cabinet and configured to receive at least one coin from said user, said coin mechanism being in mechanical communication with said hopper to control said hopper to output said product piece to said flipper from said reservoir responsively to receipt of said at least one coin;

a rod horizontally secured to said cabinet and slidably received through a vertical hole in said coin mechanism to retain said coin mechanism in said cabinet;

a coin box horizontally slidably received into said cabinet below and in communication with said coin mechanism to receive said at least one coin therefrom, said coin box receiving an end of said rod to retain said coin box in said cabinet; and a stop operatively shaped so that said stop is unable to pass through said vertical hole in said coin mechanism, said stop being removably disposed on said rod so that, when disposed on said rod, said stop prevents removal of said rod from said hole and that, when removed from said rod, said rod is slidably removable from said hole, wherein said cabinet includes a transparent front panel vertically slidably received therein to form a front boundary of said game area, said front panel define a recess to receive said coin mechanism and said coin box.

22. A coin-operated vending machine, said vending machine comprising:

a cabinet defining a game area and defining a reservoir for receiving pieces of product;

means for outputting said product pieces from said area to a user;

means for propelling a said product piece through said game area to said outputting means;

means for receiving said product piece from said reservoir and outputting said product piece to said propelling means; and means for receiving at least one coin from said user and controlling said product piece receiving and outputting means to output said product piece to said propelling means from said reservoir responsively thereto, wherein said cabinet includes a transparent front panel vertically slidably received therein and forming a front boundary of said game area.

23. A coin-operated vending machine, said vending machine comprising:

a cabinet defining a reservoir for receiving pieces of product;

an output mechanism configured to output said product pieces from said cabinet;

a hopper disposed in said cabinet in communication with said reservoir, said hopper being configured to receive said product piece from said reservoir and to output said product pieces to said output mechanism; and a coin mechanism in operative communication with said hopper and configured to receive at least one coin from a user and to control said hopper to output said product piece to said output mechanism responsively thereto, wherein said cabinet slidably receives said coin mechanism and includes a panel engaging said coin mechanism to prevent removal of said coin mechanism from said cabinet.

24. The vending machine as in claim 23, including a propelling mechanism disposed operatively between said hopper and such output mechanism to receive said product piece from said hopper, said propelling mechanism being configured to propel said product piece through a portion of said cabinet to said output mechanism.

25. The vending machine as in claim 23, wherein said coin mechanism defines at least one slot extending in a direction normal to the direction in which said coin mechanism is slidably received by said cabinet and wherein said panel is slidably received by said at least one slot to prevent said removal.

26. The vending machine as in claim 25, including two said slots defined on opposite sides of said coin mechanism parallel to each other.

27. The vending machine as in claim 23, wherein said panel defines a front surface of said cabinet.

28. The vending machine as in claim 23, wherein said panel is slidably received by said cabinet.

29. The vending machine as in claim 23, including a coin box slidably received into said cabinet and in communication with said coin mechanism to receive said at least one coin therefrom, wherein said panel engages said coin box to prevent removal of said coin box from said cabinet.

30. The vending machine as in claim 23, including a locking mechanism separate from said panel and engaging said coin mechanism to prevent removal of said coin mechanism from said cabinet.

31. The vending machine as in claim 30, wherein said locking mechanism includes a rod secured within said cabinet and extending through said coin mechanism in a direction normal to the direction in which said coin mechanism is slidably received by said cabinet.

32. A coin-operated vending machine, said vending machine comprising:

a cabinet defining a reservoir for receiving pieces of product;

an output mechanism configured to output said product pieces from said cabinet;

a hopper disposed in said cabinet in communication with said reservoir, said hopper being configured to receive said product piece from said reservoir and to output said product pieces to said output mechanism; and a coin box slidably received into said cabinet and in communication with said coin mechanism to receive said at least one coin therefrom, wherein said cabinet includes a panel engaging said coin box to prevent removal of said coin box from said cabinet.

33. The vending machine as in claim 32, wherein said coin box defines at least one slot extending in a direction normal to the direction in which said coin box is slidably received by said cabinet and wherein said panel is slidably received by said at least one slot to prevent said removal.

34. The vending machine as in claim 33, including two said slots defined on opposite sides of said coin mechanism parallel to each other.

35. The vending machine as in claim 10, wherein said front panel defines a recess to slidably receive said coin box.

* * * * *